US008769979B2

(12) United States Patent
Timbs et al.

(10) Patent No.: US 8,769,979 B2
(45) Date of Patent: Jul. 8, 2014

(54) APPARATUS AND METHOD FOR DRAINING CONDENSATE

(75) Inventors: James Frank Timbs, Winona, MS (US); Christopher D. Beck, Grenada, MS (US); John Lawson Bauer, Jr., Grenada, MS (US)

(73) Assignee: Lennox Manufacturing, Inc., Richardson, TX (US)

( * ) Notice: Subject to any disclaimer, the term of this patent is extended or adjusted under 35 U.S.C. 154(b) by 1538 days.

(21) Appl. No.: 12/061,881

(22) Filed: Apr. 3, 2008

(65) Prior Publication Data

US 2009/0249812 A1 Oct. 8, 2009

(51) Int. Cl.
*F25D 21/14* (2006.01)
*F24F 13/22* (2006.01)

(52) U.S. Cl.
CPC ..... *F24F 13/222* (2013.01)
USPC ..... 62/288; 62/285; 62/291

(58) Field of Classification Search
USPC ..... 62/285, 288–291
See application file for complete search history.

(56) References Cited

U.S. PATENT DOCUMENTS

| | | | | |
|---|---|---|---|---|
| 5,284,027 | A * | 2/1994 | Martin, Sr. | 62/291 |
| 5,904,053 | A | 5/1999 | Polk et al. | |
| 5,938,933 | A | 8/1999 | Williams et al. | |
| 5,987,909 | A * | 11/1999 | Martin, Sr. | 62/291 |
| 6,112,536 | A | 9/2000 | Hansen | |
| 6,868,689 | B1 * | 3/2005 | McNeil et al. | 62/285 |
| 6,892,907 | B2 | 5/2005 | Varney | |
| 7,185,513 | B2 | 3/2007 | Bush et al. | |
| 2004/0250841 | A1 | 12/2004 | Kimbrough et al. | |
| 2006/0191289 | A1 | 8/2006 | Bush et al. | |
| 2008/0018001 | A1 | 1/2008 | Kammerzell et al. | |

* cited by examiner

*Primary Examiner* — Cassey D Bauer

(57) ABSTRACT

An apparatus for draining condensate accumulated by an air handling unit element, the element presenting a footprint area, includes: a substantially unitary plurality of surfaces oriented between a first level and a second level and bounded by a peripheral wall. The first level is generally higher than the second level in an installed orientation. A first surface is situated substantially at the first level and is generally horizontal and presents a generally planar expanse generally coextensive with the footprint area in the installed orientation. A second surface generally extends from the second level at a first end of the apparatus to the first level at two loci separated by the first surface at a second end of the apparatus opposite the first end to orient the first surface in a generally nested relationship with respect to the second surface. At least one third surface joins the first and second surfaces.

10 Claims, 4 Drawing Sheets

10

APPARATUS AND METHOD FOR DRAINING CONDENSATE

FIELD

The present invention is directed to draining apparatuses and methods, and especially to draining apparatuses and methods configured for use with an air handling element such as may be found in a HVAC (Heating Ventilating and Air Conditioning) system.

BACKGROUND

Cost of manufacture, amenability to fostering air flow and reduction of condensate blow-flow resulting from air flow across surface of condensate are problems faced by designers air handling systems such as may be found in a HVAC system.

Eliminating a portion of a drain apparatus or drain pan to conform with a "V" shaped coil assembly may reduce the amount of material employed in manufacturing the drain pan, thereby reducing cost of manufacture of the drain pan. Fashioning the drain pan in such a "V" shape also serves to reduce the surface area of collected condensate in the drain pan so that condensate blow off or blown-flow of condensate effected by passage of air flow over the surface of collected condensate may be reduced.

Providing a slope having a high end upstream of air flow across the drain pan and a low end downstream of air flow across the drain pan creates a low water retention pan. Providing drain apertures at the low end of the pan contributes further to providing such a low water retention pan. Providing a trough or channel in the drain pan leading condensate or water toward the drain apertures at the low end of the drain pan still further contributes to providing a low water retention pan.

Providing a rib or similar raised structure in the pan may facilitate positioning a coil assembly in the drain pan and may be oriented to contribute an air dam effect to reduce blown-flow of condensate from the pan.

There is a need for a condensate drain pan and method for draining condensate that can provide reduced blown-flow of collected condensate from the pan.

There is a need for a condensate drain pan that can provide low water retention.

There is a need for a condensate drain pan that can be manufactured with less material to effect lower cost manufacture of the pan.

SUMMARY

An apparatus for draining condensate accumulated by an air handling unit element, the element presenting a footprint area, includes: a substantially unitary plurality of surfaces oriented between a first level and a second level and bounded by a peripheral wall. The first level is generally higher than the second level in an installed orientation. A first surface is situated substantially at the first level and is generally horizontal and presents a generally planar expanse generally coextensive with the footprint area in the installed orientation. A second surface generally extends from the second level at a first end of the apparatus to the first level at two loci at a second end of the apparatus opposite the first end to orient the first surface in a generally nested relationship with respect to the second surface. At least one third surface joins the first and second surfaces.

A method for draining condensate accumulated by an air handling unit element, the element presenting a footprint area, includes: (a) in no particular order: (1) providing the element; the element presenting a footprint area; and (2) providing a draining apparatus; the draining apparatus comprising: a substantially unitary plurality of surfaces oriented between a first level and a second level and bounded by a peripheral wall; the first level being generally higher than the second level in an installed orientation; a first surface of the plurality of surfaces being situated substantially at the first level and being generally horizontal and presenting a generally planar expanse generally coextensive with the footprint area in the installed orientation; a second surface of the plurality of surfaces generally extending from the second level at a first end of the apparatus to the first level at two loci at a second end of the apparatus opposite the first end to orient the first surface in a generally nested relationship with respect to the second surface; at least one third surface of the plurality of surfaces joining the first surface with the second surface; and (b) orienting the element and the draining apparatus in generally abutting relation in the installed orientation.

There is a need for an apparatus and method for draining condensate that can provide reduced blown-flow of collected condensate.

There is a need for an apparatus and method for draining condensate that can provide low water retention.

There is a need for an apparatus for draining condensate that can be effected using less material to effect lower cost manufacture of the apparatus Further features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

The present invention is particularly suited to use for, and will be described in this disclosure in terms of, an apparatus and method for draining condensate accumulated by an air handling unit element, such as a coil unit. However, one skilled in the art of liquid draining apparatuses and methods will recognize that the invention may be suitable for other environments than the exemplary environment described herein.

Figure 1:
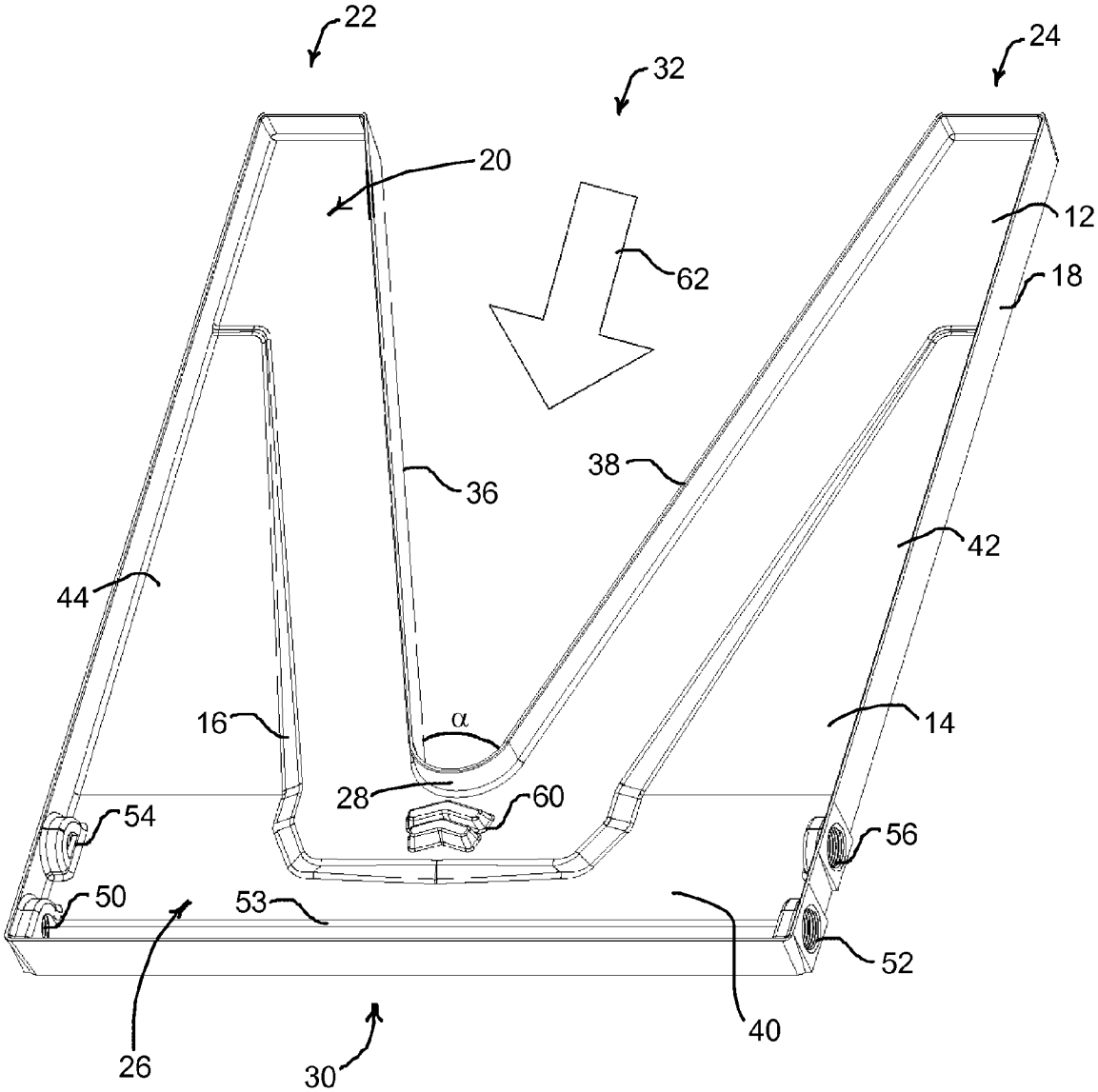
FIG. 1 is a perspective view of a drain apparatus configured according to the teachings of the present invention.

FIG. 1 is a perspective view of a drain apparatus configured according to the teachings of the present invention. In FIG. 1, a drain apparatus 10 includes a first surface 12, a second surface 14 and a third surface 16. Surfaces 12, 14, 16 are surrounded by a peripheral wall 18. Drain apparatus 10 extends between a first end 30 and a second end 32. First surface 12 is situated generally at a first level 20. First surface 12 is preferably substantially planar and has a width substantially coextensive with a unit from which liquid may be collected such as, by way of example and not by way of limitation, a portion of a coil assembly (see FIG. 3). Second surface 14 extends from a second level 26 at first end 30 to first level 20 at two loci 22, 24 located at second end 32. First level 20 is higher than second level 26 when drain apparatus 10 is in an installed orientation (see FIG. 3).

First surface 12 extends from loci 22, 24 toward an intersection locus 28 to form a "V" shape having two portions or legs 36, 38 depending from intersection locus 28 in departing vectors establishing an acute angle α between portions or legs 36, 38. First surface 12 is thereby established in a generally nested relation with respect to second surface 14. Said another way, first surface 12 extends into second surface 14 in the manner of a peninsula extending into an ocean. Third surface 16 joins first surface 12 and second surface 14 to present drain apparatus 10 as a substantially unitary plurality of surfaces. Second surface 14 may be configured in segments of generally planar surfaces 40, 42, 44.

Drain apparatus 10 may be manufactured using any of several techniques in any of several materials such as, by way of example and not by way of limitation, a metal material formed by stamping, drawing or otherwise fashioned; a plastic material formed by molding or by using another material or manufacturing technique.

Drain apertures 50, 52 traverse peripheral wall 18 generally at first end 30. This orientation places drain apertures 50, 52 substantially at the lowest level of drain apparatus 10 in its installed orientation (see FIG. 3) to promote drainage of liquids such as condensate from drain apparatus 10. A trough or channel 53 may be provided in second surface 14 leading toward drain apertures 50, 52 to provide an even lower portion of second surface 14 so as to promote draining of liquids through drain apertures 50, 52. Auxiliary or additional drain apertures 54, 56 may be provided traversing peripheral wall 18 at a level above drain apertures 50, 52. Situating auxiliary or additional drain apertures 54, 56 above drain apertures 50, 52 assures that auxiliary or additional drain apertures 54, 56 serve to augment drainage effected by drain apertures 50, 52. By way of example and not by way of limitation, auxiliary or additional drain apertures 54, 56 may be relied upon to effect draining drain apparatus 10 when drain apertures 50, 52 become clogged or otherwise obstructed. Auxiliary or additional drain apertures 54, 56 may be established with a smaller opening than is provided by drain apertures 50, 52, as illustrated by way of example and not by way of limitation in FIG. 1 by providing auxiliary or additional drain apertures with a semi-circular opening having a diameter similar to the fully circular opening of drain apertures 50, 52. Providing the same diameter for all of drain apertures 50, 52, 54, 56 facilitates use of common sized connectors for all of drain apertures 50, 52, 54, 56.

A flow-disrupting structure 60 may be provided to reduce blown-flow of liquid from drain apparatus 10. By way of example and not by way of limitation, if air is directed to traverse drain apparatus 10 in a direction indicated generally by an arrow 62 generally parallel with first surface 12, condensate collected on first surface 12 may be blown to a location outside of drain apparatus 10. Such a blown-flow of liquid may be in the form of drops, droplets, spray or another form and may interfere with operation of equipment with which drain apparatus 10 is employed. Flow disrupting structure 60 may serve also to aid in locating an element with respect to first surface 12. Flow disrupting structure 60 is described in greater detail in connection with FIG. 2.

Figure 2:
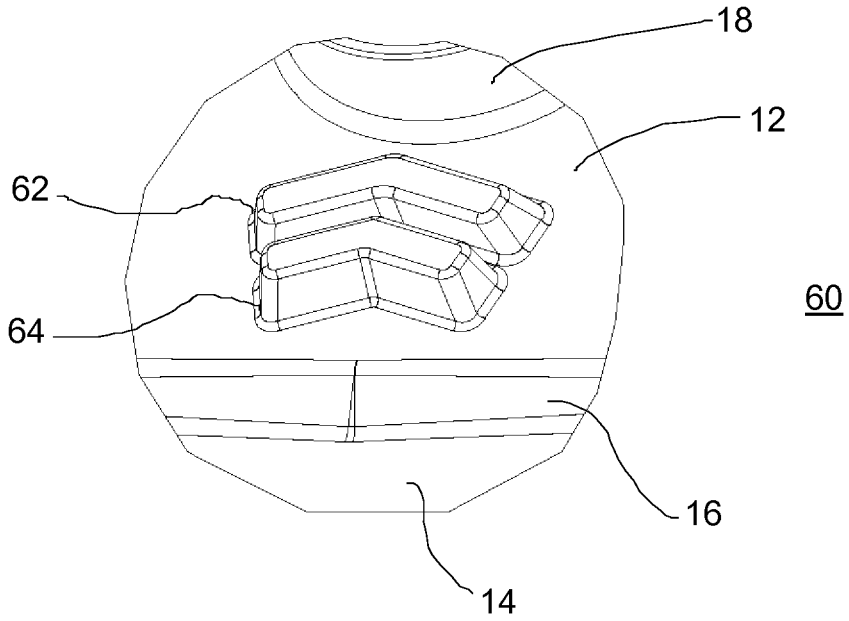
FIG. 2 is a perspective view of a detail of the air dam structure of the drain apparatus illustrated in FIG. 1.

FIG. 2 is a perspective view of a detail of the air dam structure of the drain apparatus illustrated in FIG. 1. In FIG. 2, flow disrupting structure 60 includes a pair of spaced dam structures 62, 64. Dam structures 62, 64 are, by way of example and not by way of limitation, configured as chevron-shaped extensions from first surface 12 in a direction away from second surface 14. Dam structures 62, 64 are situated generally symmetrically with respect to intersection locus (see FIG. 1). Dam structures may be formed or provided by any method appropriate such as, by way of example and not by way of limitation, molding, embossing, stamping, depositing, adhering or another method of forming. Dam structures 62, 64 may advantageously be configured to perform an additional function of fixing position of an element to be employed with drain apparatus 10, such as a coil element of a HVAC system (see FIG. 3).

Figure 3:
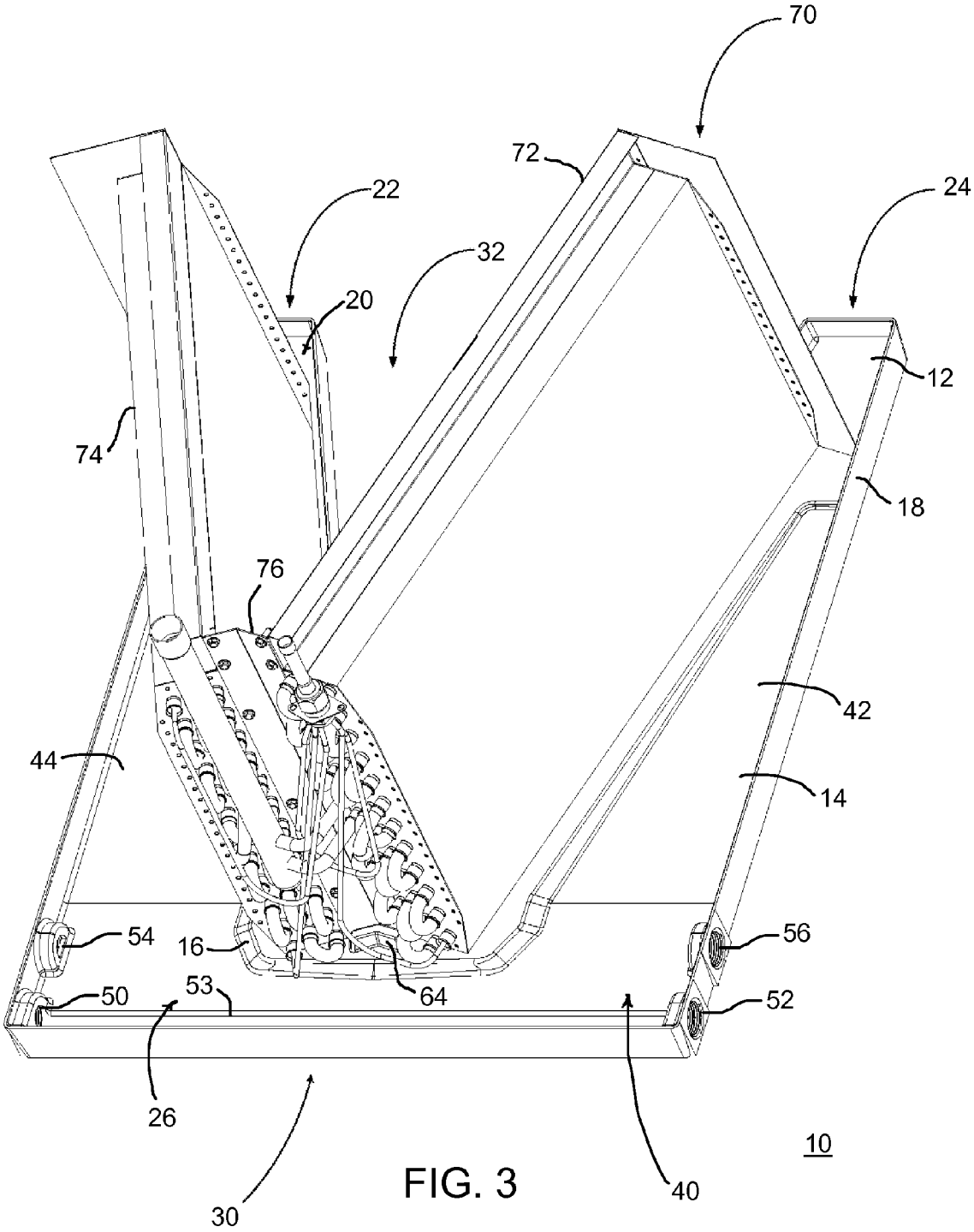
FIG. 3 is a perspective view of the drain apparatus illustrated in FIG. 1 with a coil assembly in an installed orientation.

FIG. 3 is a perspective view of the drain apparatus illustrated in FIG. 1 with a coil assembly in an installed orientation. In FIG. 3, a drain apparatus 10 includes a first surface 12, a second surface 14 and a third surface 16. Surfaces 12, 14, 16 are surrounded by a peripheral wall 18. Drain apparatus 10 extends between a first end 30 and a second end 32. First surface 12 is situated generally at a first level 20. First surface 12 is preferably substantially planar and has a width substantially coextensive with a unit from which liquid may be collected such as, by way of example and not by way of limitation, a portion of a coil unit or assembly 70. Second surface 14 extends from a second level 26 at first end 30 to first level 20 at two loci 22, 24 located at second end 32. First level 20 is higher than second level 26 when drain apparatus 10 is in an installed orientation, as illustrated in FIG. 3.

First surface 12 extends from loci 22, 24 toward an intersection locus 28 to form a "V" shape having two portions or legs 36, 38 depending from intersection locus 28 in departing vectors establishing an acute angle α between portions or legs 36, 38 (see FIG. 1). First surface 12 is thereby established in a generally nested relation with respect to second surface 14. Said another way, first surface 12 extends into second surface 14 in the manner of a peninsula extending into an ocean. Third surface 16 joins first surface 12 and second surface 14 to present drain apparatus 10 as a substantially unitary plurality of surfaces. Second surface 14 may be configured in segments of generally planar surfaces 40, 42, 44.

Drain apparatus 10 may be manufactured using any of several techniques in any of several materials such as, by way of example and not by way of limitation, a metal material formed by stamping, drawing or otherwise fashioned; a plastic material formed by molding or by using another material or manufacturing technique.

Coil assembly 70 may be associated with a HVAC system (not shown in FIG. 3; understood by those skilled in the art of HVAC system design) and includes a first element 72 and a second element 74 coupled in a "V" orientation by a joining element 76. Elements 72, 74 rest in substantially abutting relation substantially in register with first surface 12 at first level 20. Joining element 76 may be an angled sheet of material such as metal configured to serve a secondary purpose cooperating with flow disrupting structure 60 by resting between dam structures 62, 64 (only dam structure 64 is visible in FIG. 3) to position coil assembly 70 in the installed orientation illustrated in FIG. 3.

Drain apertures 50, 52 traverse peripheral wall 18 generally at first end 30. This orientation places drain apertures 50, 52 substantially at the lowest level of drain apparatus 10 in the installed orientation illustrated in FIG. 3 to promote drainage of liquids such as condensate from drain apparatus 10. A trough or channel 53 may be provided in second surface 14 leading toward drain apertures 50, 52 to provide an even lower portion of second surface 14 so as to promote draining of liquids through drain apertures 50, 52. Auxiliary or additional drain apertures 54, 56 may be provided traversing peripheral wall 18 at a level above drain apertures 50, 52. Situating auxiliary or additional drain apertures 54, 56 above drain apertures 50, 52 assures that auxiliary or additional drain apertures 54, 56 serve to augment drainage effected by drain apertures 50, 52. By way of example and not by way of limitation, auxiliary or additional drain apertures 54, 56 may be relied upon to effect draining drain apparatus 10 when drain apertures 50, 52 become clogged or otherwise obstructed. Auxiliary or additional drain apertures 54, 56 may be established with a smaller opening than is provided by drain apertures 50, 52 by providing auxiliary or additional drain apertures with a semi-circular opening having a diameter similar to the fully circular opening of drain apertures 50, 52. Providing the same diameter for all of drain apertures 50, 52, 54, 56 facilitates use of common sized connectors for all of drain apertures 50, 52, 54, 56.

Flow-disrupting structure 60 may be provided to reduce blown-flow of liquid from drain apparatus 10. By way of example and not by way of limitation, if air is directed to traverse drain apparatus 10 in a direction generally parallel with first surface 12, condensate collected on first surface 12 may be blown to a location outside of drain apparatus 10. Such a blown-flow of liquid may be in the form of drops, droplets, spray or another form and may interfere with operation of equipment with which drain apparatus 10 is employed.

Condensate may emanate from elements 72, 74 of coil unit 70, proceed down in response to gravity to encounter first surface 12, proceed further to second surface 14 and then proceed to drain apertures 50, 52. Some condensate may traverse third surface 16 while proceeding from first surface 12 to second surface 14.

Figure 4:
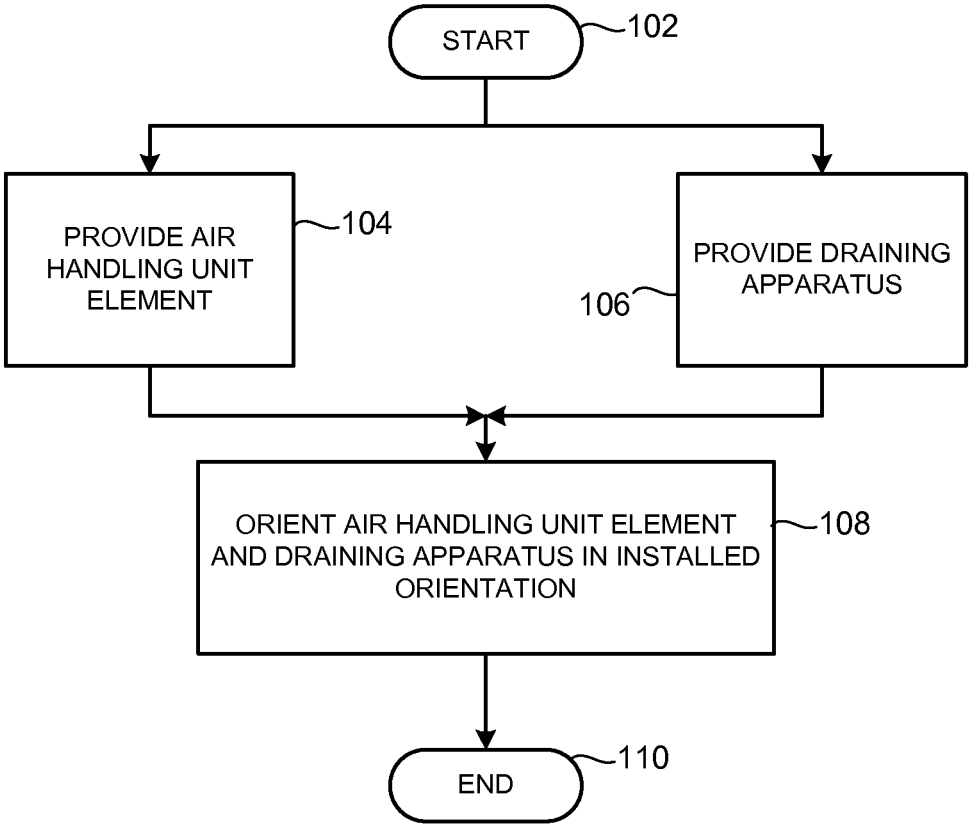
FIG. 4 is a flow chart illustrating the method of the present invention.

FIG. 4 is a flow chart illustrating the method of the present invention. In FIG. 4, a method 100 for draining condensate accumulated by an air handling unit element, the element presenting a footprint area, begins at a START locus 102.

Method 100 continues with, in no particular order: (1) providing the element, as indicated by a block 104, and (2) providing a draining apparatus, as indicated by a block 106. The element presents a footprint area. The draining apparatus includes a substantially unitary plurality of surfaces oriented between a first level and a second level and bounded by a peripheral wall. The first level is generally higher than the second level in an installed orientation. A first surface of the plurality of surfaces is situated substantially at the first level, is generally horizontal and presents a generally planar expanse generally coextensive with the footprint area in the installed orientation. A second surface of the plurality of surfaces generally extends from the second level at a first end of the apparatus to the first level at two loci at a second end of the apparatus opposite the first end to orient the first surface in a generally nested relationship with respect to the second surface. At least one third surface of the plurality of surfaces joins the first surface with the second surface.

Method 100 continues with orienting the element and the draining apparatus in generally abutting relation in the installed orientation, as indicated by a block 108. Method 100 terminates at an end locus 110.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A draining apparatus comprising:

a substantially unitary plurality of surfaces oriented between a first level and a second level and bounded by a peripheral wall, said first level being higher than said second level in an installed orientation, said substantially unitary plurality of surfaces including:

a first surface of said plurality of surfaces being generally horizontal and presenting a generally planar expanse situated substantially at said first level in said installed orientation;

a second surface of said plurality of surfaces generally extending from said second level at a first end of the apparatus to said first level at a second end of the apparatus opposite said first end to orient said first surface in a generally peninsular relationship with respect to said second surface; and at least one third surface of said plurality of surfaces joining said first surface with said second surface; and at least one flow-disrupting structure situated at said first surface, each respective flow-disrupting structure configured as chevron-shaped and extending from said first surface in a direction away from said second level, wherein said apparatus is configured for use with an element having a "V" shaped footprint area and said at least one flow-disrupting structure includes a pair of dam structures situated generally symmetrically with respect to an intersection locus of two legs of said "V" shaped footprint area.

2. A draining apparatus as recited in claim 1 wherein the apparatus is configured for use with an element having a footprint area with a "V" shape having two portions with substantially equal widths and substantially equal lengths; said two portions depending from a common locus in departing vectors establishing an acute angle, and wherein said planar expanse is generally coextensive with said footprint area.

3. A draining apparatus as recited in claim 1 wherein the apparatus further comprises a plurality of drain apertures traversing said peripheral wall generally at said first end.

4. A draining apparatus as recited in claim 3 wherein said second surface includes a surface departure generally establishing a channel leading substantially to at least one drain aperture of said plurality of drain apertures.

5. A draining apparatus as recited in claim 1 wherein the apparatus is configured for use with an element having a footprint area with a "V" shape having two portions with substantially equal widths and substantially equal lengths; said two portions depending from a common locus in departing vectors establishing an acute angle, and wherein said planar expanse is generally coextensive with said footprint area.

6. A draining apparatus as recited in claim 5 wherein the apparatus further comprises a plurality of drain apertures traversing said peripheral wall generally at said first end.

7. A draining apparatus as recited in claim 6 wherein said second surface includes a surface departure generally establishing a channel leading substantially to at least one drain aperture of said plurality of drain apertures.

8. A method for draining condensate accumulated by an air handling unit element; said element presenting a footprint area; the method comprising:

(a) in no particular order:

(1) providing said element; said element presenting a footprint area; and (2) providing a draining apparatus; said draining apparatus comprising:

a substantially unitary plurality of surfaces oriented between a first level and a second level and bounded by a peripheral wall, said first level being generally higher than said second level in an installed orientation, said substantially unitary plurality of surfaces including:

a first surface of said plurality of surfaces being situated substantially at said first level and being generally horizontal and presenting a generally planar expanse generally coextensive with said footprint area in said installed orientation;

a second surface of said plurality of surfaces generally extending from said second level at a first end of the apparatus to said first level at two loci at a second end of the apparatus opposite said first end to orient said first surface in a generally nested relationship with respect to said second surface; and at least one third surface of said plurality of surfaces joining said first surface with said second surface; and at least one flow-disrupting structure situated at said first surface, each respective flow-disrupting structure configured as chevron-shaped and extending from said first surface in a direction away from said second level; and (b) orienting said element and said draining apparatus in generally abutting relation in said installed orientation, wherein said footprint area is a "V" shaped footprint area and said at least one flow-disrupting structure includes a pair of dam structures situated generally symmetrically with respect to a locus in said footprint area, said locus being an intersection locus of two legs of said "V" shaped footprint area.

9. A method for draining condensate accumulated by an air handling unit element as recited in claim 8 wherein said "V" shaped footprint area has two portions with substantially equal widths and substantially equal lengths; said two portions depending from a common locus in departing vectors establishing an acute angle.

10. A method for draining condensate accumulated by an air handling unit element as recited in claim 9 wherein the apparatus further comprises a plurality of drain apertures traversing said peripheral wall generally at said first end.

* * * * *